US006961440B1

(12) United States Patent
Schlaegel

(10) Patent No.: US 6,961,440 B1
(45) **Date of Patent: *Nov. 1, 2005**

(54) ELECTRO-ACOUSTIC SYSTEM

(75) Inventor: Norm D. Schlaegel, Fremont, CA (US)

(73) Assignee: Pacific Coast Laboratories, Inc., San Leandro, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/501,796

(22) Filed: Feb. 8, 2000

(51) Int. Cl.[7] ..... H04R 25/00
(52) U.S. Cl. ..... 381/382; 381/381; 181/135
(58) Field of Search ..... 381/327, 328, 381/325, 330, 380–382, FOR 132, FOR 133, FOR 134, 323, 384, 394; 181/129, 130, 135

(56) References Cited

U.S. PATENT DOCUMENTS

| | | | | | |
|---|---|---|---|---|---|
| 2,545,731 | A | * | 3/1951 | French | 181/135 |
| 2,573,132 | A | * | 10/1951 | French | 181/135 |
| 2,641,327 | A | * | 6/1953 | Balmer | 181/129 |
| 2,763,334 | A | * | 9/1956 | Starkey | 181/135 |
| 2,934,160 | A | * | 4/1960 | Touson | 181/130 |
| 3,080,011 | A | * | 3/1963 | Henderson | 128/868 |
| 3,368,644 | A | * | 2/1968 | Henderson | 181/129 |
| 3,667,569 | A | * | 6/1972 | Mackey et al. | 181/135 |
| 3,671,685 | A | * | 6/1972 | McCabe | 381/382 |
| 3,732,382 | A | * | 5/1973 | DeWitt | 181/135 |
| 4,381,830 | A | * | 5/1983 | Jelonek et al. | 181/129 |
| 4,467,145 | A | * | 8/1984 | Borstel | 381/123 |
| 4,499,593 | A | * | 2/1985 | Antle | |
| 4,803,728 | A | * | 2/1989 | Lueken | 381/309 |
| 4,829,571 | A | * | 5/1989 | Kakiuchi et al. | 381/309 |
| 4,864,619 | A | * | 9/1989 | Spates | 381/309 |
| 4,977,976 | A | * | 12/1990 | Major | 181/130 |
| 5,222,151 | A | * | 6/1993 | Nagayoshi et al. | 381/313 |
| 5,367,345 | A | * | 11/1994 | da Silva | 351/158 |
| 5,488,205 | A | * | 1/1996 | Major | 181/129 |
| 5,753,870 | A | * | 5/1998 | Schlaegel et al. | 181/129 |
| 5,757,932 | A | * | 5/1998 | Lindemann et al. | 381/312 |
| 5,790,684 | A | * | 8/1998 | Niino | 381/151 |
| 5,975,235 | A | * | 11/1999 | Schlaegel et al. | 181/129 |

FOREIGN PATENT DOCUMENTS

| | | | | |
|---|---|---|---|---|
| JP | 11250740 A | * | 9/1999 | H01B/7/06 |
| WO | WO 9602921 A1 | * | 2/1996 | H01B/13/00 |

OTHER PUBLICATIONS http//:www.earmolddesign.com; Designers of quality custom earmolds. Catalog index.*

* cited by examiner

*Primary Examiner*—Curtis Kuntz
*Assistant Examiner*—P. Dabney
(74) *Attorney, Agent, or Firm*—Dorsey & Whitney LLP

(57) ABSTRACT

An electro-acoustic system for use with an electronic sound-generating member including a fitted earmold having a sound-conduction bore extending therethrough, a sound-conduction tubing having one end connected to the sound-conduction bore and being curved so as to extend along a person's head between the person's head and an ear, a speaker having one end connected to another end of the sound-conduction tubing, an electrical cable having one end connected to the speaker, and an electrical plug at the other for electrical connection to an electronic sound-generating equipment.

4 Claims, 2 Drawing Sheets

ELECTRO-ACOUSTIC SYSTEM

FIELD OF THE INVENTION

The present invention relates to an electro-acoustic system and more particularly to an electro-acoustic system for use in connection with a radio receiver, compact disc (CD) player or other electronic sound-generating equipment.

BACKGROUND OF THE INVENTION

Earphones are used in connection with radio receivers, CD players, telephones or the like. One conventional type of earphones has earmuffs which fit over the ears and are connected together by a spring that urges the earmuffs against the ears. Another conventional type of earphones is of the earplug type wherein earplugs extend into the respective ear canals. The earplugs have a configuration that can be universally worn by all persons. These prior art earphones allow outside sounds to enter the ears. While outside sounds are disturbing when listening to radio, CD player or the like, it is important to prevent outside sounds from entering the ears if the radio receiver is being used by a policeman, fireman or other official.

OBJECTS AND SUMMARY OF THE INVENTION

An object of the present invention is to provide an electro-acoustic system that transmits distortionless sound to an ear or ears from electronic sound-generating equipment.

It is another object of the present invention to provide an electro-acoustic system which employs fitted earmold.

The present invention is realized as an electro-acoustic system which comprises an earmold which is configured to fit into an ear and having a sound-conduction bore extending therethrough, a connector having an inner end fitted into an outer end of the sound-conduction earmold bore, a sound-conduction tubing with one end secured within an outer end of the connector and another end secured within a speaker assembly, an electrical cable having one end electrically connected to the speaker assembly, and an electrical plug at the other end of the electrical cable for electrical connection to electronic sound-generating equipment.

Preferably, the sound-conduction tubing has a curved configuration so as to fit behind the ear between the ear and the head, the electrical cable has a coiled section, and the sound-conduction bore has a seating member for connecting the connector to the earmold.

The sound-conduction bore, the sound-conduction connector bore and the sound-conduction tubing bore have a consistent diameter therealong thereby providing a smooth and continuous path from the speaker to the ear whereby the acoustical characteristics of the sound emanating from the speaker and traveling along the smooth and continuous path into the ear is not changed thereby, resulting in improved fidelity.

BRIEF DESCRIPTION OF THE DRAWINGS

Embodiments of the present invention will now be described by way of example with reference to the accompanying drawings in which.

DETAILED DESCRIPTION OF THE INVENTION

Figure 1:
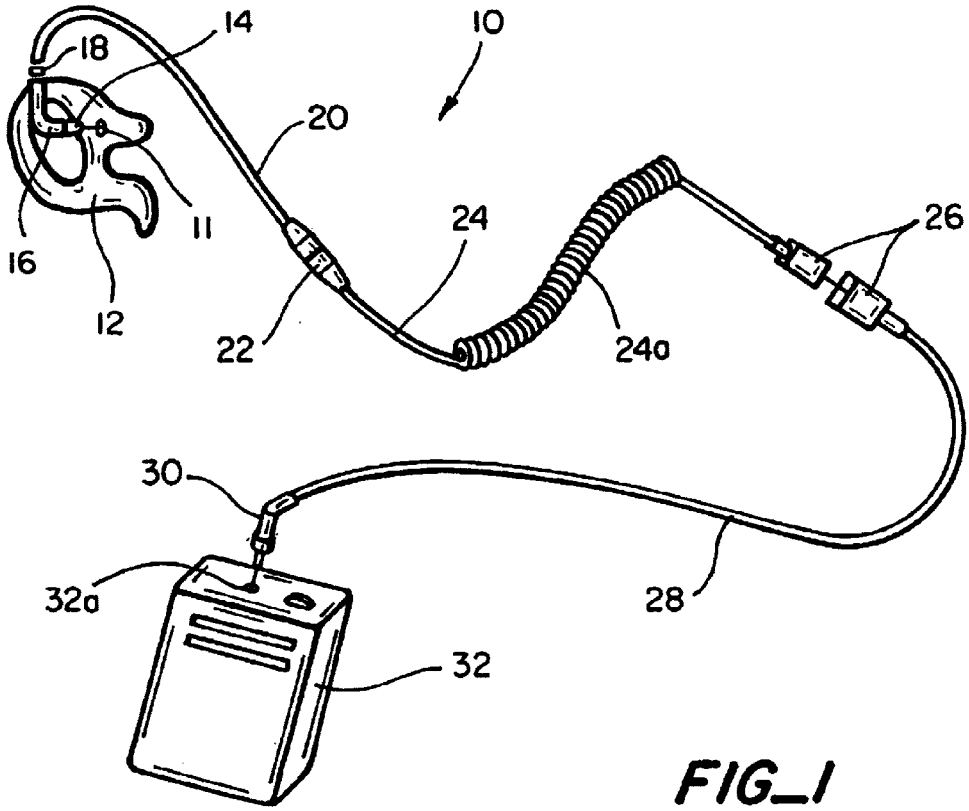
FIG. 1 is an exploded perspective view of a monaural electro-acoustic system and a radio receiver.
Figure 2:
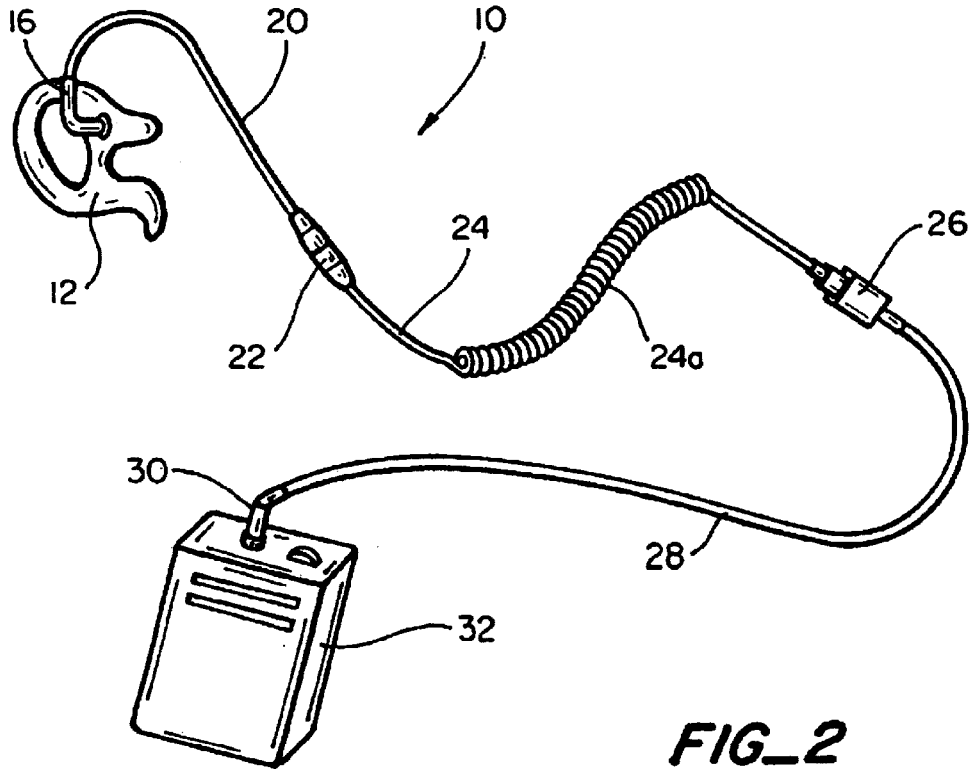
FIG. 2 is a view similar to FIG. 1 showing an assembled electro-acoustic system connected to the radio receiver.
Figure 3:
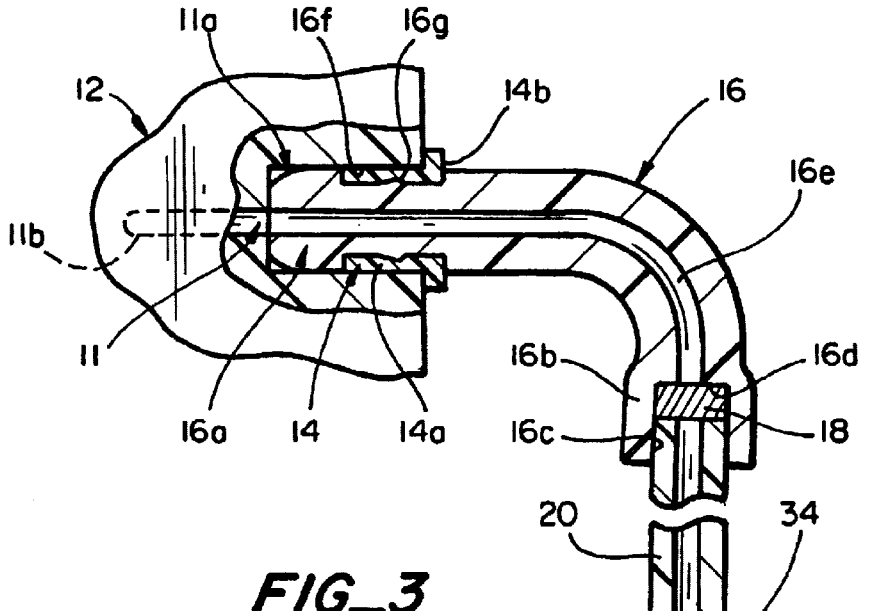
FIG. 3 is a cross-sectional view of part of the earmold, seating member, earmold-tubing connector, filter, sound-conduction tubing and a speaker.

The monaural electro-acoustic system 10 shown in FIGS. 1–3 includes an earmold 12, seating member 14, earmold-tubing connector 16, filter 18, sound-conduction tubing 20, speaker assembly 22, a coiled electrical cable 24, an electrical connector 26, an electrical cable 28, an electrical plug 30 and a radio receiver 32.

Earmold 12 is molded from a suitable plastic material to conform to and frictionally fit within a person's ear. The earmold is a pliable plastic that is compressible when finger and thumb pressure is applied thereto which classifies it as a soft plastic material. The earmold can also be made of a rigid plastic material.

Referring specifically to FIG. 3, the earmold 10 includes a sound-conduction bore 11 extending therethrough with an outer section 11*a*, having a diameter larger than sound-conducting bore 11*b*, extending from the outer section 11*a* to the end of the portion of the earmold that extends into the ear channel.

Seating member 14 has an annular section 14*a* and an annular shoulder 14*b* at an outer end. Seating member 14 is molded from a suitable plastic material and it is secured in outer section 11*a* of sound-conduction bore 11 as shown in FIG. 3 with annular section 14*a* disposed in outer section 11*a* and annular shoulder 14*b* abutting against a surface of earmold 12 thereby limiting the movement of annular section 14*a* within outer section 11*a*. A space is provided within outer section 11*a* between inner end of annular section 14*a* and inner end of outer section 11*a*. The outer diameter of annular section 14*a* is about the same as that of outer section 11*a* so that annular section 14*a* fits snugly therein. A conventional adhesive can be used to secure the seating member 14 in position in outer section 11*a*.

Connector 16 is molded from a suitable plastic material such as clear vinyl. It is elbow-shaped with a bend of about 80 degrees. Connector 16 has a latching section in the form of a nubbin 16*a* at one end and a tubing-receiving section 16*b* at the other end. Tubing-receiving section 16*b* has a bore 16*c* that has a diameter only slightly larger than the outside diameter of sound-conduction tubing 20 so that an inner end of sound-conduction tubing 20 can be readily and frictionally fitted within bore 16*c* against filter 18 which abuts shoulder 16*d*. Filter 18 can be omitted if desired, then the end of the sound-conduction tubing 20 will abut shoulder 16*d*. A conventional vinyl glue can be used to secure tubing 20 within the tubing-receiving section 16*b* of connector 16.

Filter 18 is a conventional filter and is manufactured by Knowles Electronics, Inc., Itasco, Ill. The filter is generally of 680 to 4700 ohms.

A sound-conduction tubular passage 16e extends through connector 16 from bore 16*c* to the end of nubbin 16*a* and its diameter is the same as the inside diameter of sound-conduction tubing 20. An annular recess 16f is located in connector 16 rearward of nubbin 16*a*. The recess includes an annular barb 16*g* having a tapered outer surface and a vertical inner surface.

Connector 16 is mounted in sound-conduction bore 11 of earmold 12 as shown in FIG. 3 with nubbin 16*a* extending through seating member 14 and being disposed in the space within outer section 11*a*. The inner surface of nubbin 16*a* engages the inner end of seating member 14. Annular barb 16*g* bitingly engages an inner surface of seating member 14. The outer surface of annular recess 16*f* engages annular shoulder 14*b*. Thus, the nubbin end of connector 16 is latchably secured in seating member 14 to secure connector 16 within earmold 12. The nubbin 16*a* in conjunction with annular barb 16*g* provides better latching of connector 16 with earmold 12 and also prevents leakage of sound.

The other end of sound-conducting tubing 20 is mounted on a projection 34 of a conventional speaker 36 housed in speaker assembly 22. The speaker is encased in a two-part plastic housing 38 that has interfitting inner ends. A suitable speaker 36 is manufactured by Knowles Electronics, Inc. The housing 38 snugly engages tubing 20 and electrical cable 24.

Electrical cable 24 is electrically connected to speaker 36 and to respective electrical contacts (not shown) in the male electrical connector of connector 26.

Electrical cable 24 has a coiled section 24*a* that enables cable 24 to be stretched after which it will return to its original position.

Electrical wires in electrical cable 28 are respectively connected to electrical contacts (not shown) in a female electrical connector of electrical connector 26 and to electrical plug 30. The plug provides for electrically connecting to an electrical socket 32*a* of the associated electronic sound-generating equipment such as a radio receiver 32. Such sound-generating equipment includes CD players, telephones, police or fire radio receivers and the like.

In use, the earmold 12 which has been molded to fit the ear is inserted in the ear and curved sound conduction tubing is extended between the head and the ear. The electrical cable 24 extends along a side of the upper part of the body. The radio receiver 32 may be attached to the body, most likely strapped to a belt at the waist. A clip (not shown) on cable 24 clips the cable to clothing so that it remains in place along the body. The curved sound-conduction tubing in place behind the ear will assist in keeping the earmold within the ear, the coiled section 24*a* of the electrical cable 24 allows freedom of movement without placing stress on the earmold.

An important feature of the present invention is that the interior diameter of the sound-conduction tubing 20, the diameter of the sound-conduction tubular passage 16*e* of connector 16, and the diameter of the sound-conducting bore 11*b* are the same so that the continuous-flow sound-conduction path having the same diameter therealong is established. Thus, the fidelity of the frequencies of sound signals emanating from the radio receiver or other sound-generating electronic equipment are more true because of the continuous-flow sound-conduction path. Adding filter 18 within bore 16*c* at the end of sound-conduction tubing 20 shapes the output and gain of the signals from the radio receiver thereby achieving much better electro-acoustic effects.

Another important feature of the present invention is the curved sound-conduction tubing extending behind a person's ear along the head maintains the earmold within the ear. Also, use of the seating member in the sound-conduction bore of the earmold enables the nubbin end of the connector to be latchably secured in the sound-conduction bore.

Figure 4:
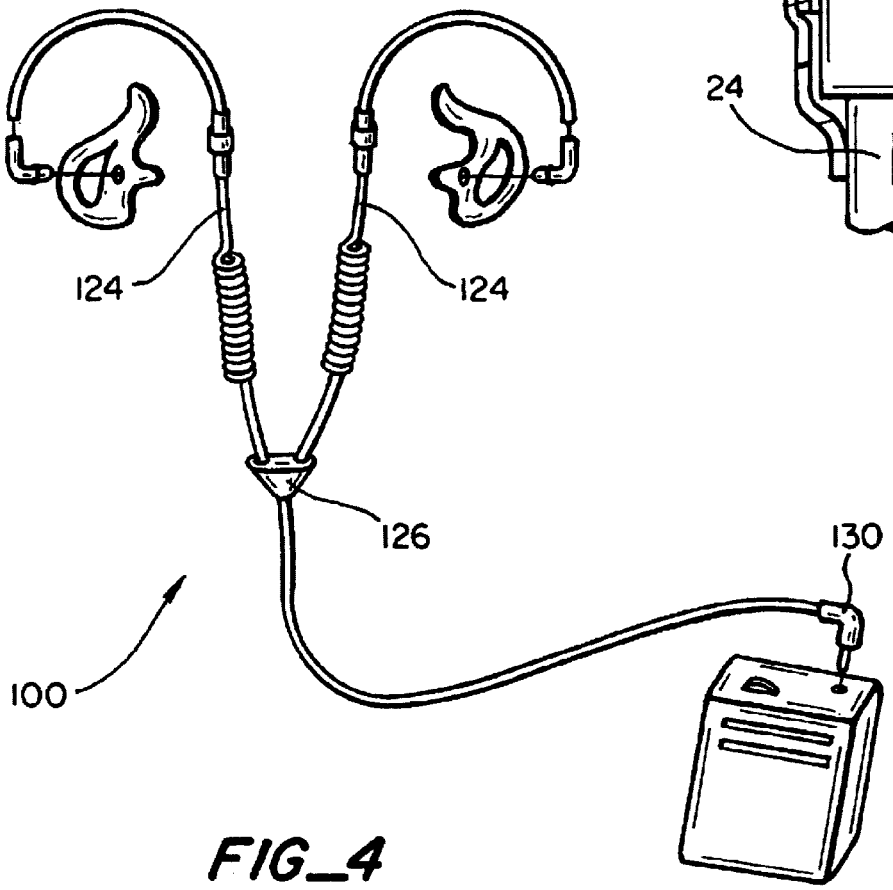
FIG. 4 is an exploded perspective view of a binaural electro-acoustic system and a radio receiver.

FIG. 4 shows a binaural electro-acoustic system 100 for use in both ears of a person and it uses the same components as the monaural electro-acoustic system 10 except that coiled electric cables 124 are interconnected in a sealed electrical connector 126 and electrical plug 130 is for binaural signals. Otherwise, the electro-acoustic system 100 is the same as that of electro-acoustic system 10.

From the foregoing, it can be discerned that a monaural and binaural electro-acoustic system for use in conjunction with portable sound-generating equipment has been disclosed whereby the sound emanating from the sound-generating equipment is transmitted along a continuous-flow sound-conduction path that is non-distorted, thereby providing better listening. Moreover, the curved configuration of the sound-conduction tubing maintains the earmold within the ear and the coiled electric cable prevents strain on the earmold.

While the present invention has been described with reference to two specific embodiments, the description is illustrative of the invention and is not to be construed as limiting the invention. Various modifications may occur to those skilled in the art without departing from the true spirit and scope of the invention as defined by the appended claims.

What is claimed is:

1. An electro-acoustic system for use with electronic sound-generating equipment, comprising:

an earmold molded to conform to and frictionally fit in and supported by the external portion of a person's ear having a sound-conduction bore extending therethrough and directed into the ear canal;

a sound-conducting connector having a tubing receiving section at one end and a latching section at the other end and a sound conducting tubular passage with the other end of the connector latchably connected to the sound conducting bore of the earmold so that the passage is opposite the sound-conduction bore and said connector having an elbow configuration having the tubing receiving section adapted to extend along the person's head between the person's head and ear;

a sound conduction tubing having one end coupled to the connector;

a speaker acoustically coupled to the other end of the sound-conduction tube for conducting sound from the speaker to the connector and into the passage;

wherein the internal diameter of the sound conducting tubing, said sound conducting connector and said sound conducting bore as the same therealong;

an electrical cable having one end connected to the speaker for driving the speaker; and an electrical plug connected to another end of the electrical cable for electrical connection to an electronic sound-generating member.

2. An electro-acoustic system as in claim 1, wherein the latching section has an annular recess, and an annular barb located in the annular recess for engaging the inner surface of the seating member.

3. An electro-acoustic system as in claim 1, wherein a space is provided in the entry section between an inner end of the seating member and an inner surface of the entry section, and a nubbin of the latching section is disposed within the space.

4. An electro-acoustic system as in claim 1, wherein the electrical cable has a coiled section.

* * * * *